US008678711B2

(12) United States Patent
Wu

(10) Patent No.: US 8,678,711 B2
(45) Date of Patent: Mar. 25, 2014

(54) MULTIFUNCTIONAL OFFSHORE BASE WITH LIQUID DISPLACEMENT SYSTEM

(76) Inventor: Zhirong Wu, Beijing (CN)

( * ) Notice: Subject to any disclaimer, the term of this patent is extended or adjusted under 35 U.S.C. 154(b) by 284 days.

(21) Appl. No.: 13/041,224

(22) Filed: Mar. 4, 2011

(65) Prior Publication Data

US 2011/0146803 A1 Jun. 23, 2011

Related U.S. Application Data

(63) Continuation-in-part of application No. PCT/CN2009/001008, filed on Sep. 7, 2009.

(30) Foreign Application Priority Data

Sep. 5, 2008 (CN) ..... 2008 1 0196337

(51) Int. Cl.
*E02D 27/38* (2006.01)

(52) U.S. Cl.
USPC ..... 405/210

(58) Field of Classification Search
USPC ..... 405/210, 223.1, 205, 206, 207, 224
See application file for complete search history.

(56) References Cited

U.S. PATENT DOCUMENTS

| | | | | | |
|---|---|---|---|---|---|
| 3,727,418 | A * | 4/1973 | Glazier | 405/210 |
| 3,766,583 | A * | 10/1973 | Phelps | 405/203 |
| 3,828,565 | A * | 8/1974 | McCabe | 405/210 |
| 3,898,846 | A * | 8/1975 | McCabe | 405/210 |
| 4,188,157 | A * | 2/1980 | Vigander | 405/210 |
| 4,209,271 | A * | 6/1980 | McCabe et al. | 405/210 |
| 4,365,576 | A * | 12/1982 | Cook | 405/200 |
| 5,201,611 | A * | 4/1993 | Komaki et al. | 405/210 |
| 2005/0163572 | A1 * | 7/2005 | Keron | 405/210 |
| 2011/0013989 | A1 | 1/2011 | Wu | |

FOREIGN PATENT DOCUMENTS

| | | |
|---|---|---|
| CN | 2772957 | 4/2006 |
| CN | 101080535 | 11/2007 |
| CN | 201043270 | 4/2008 |
| GB | 1472483 | 5/1977 |
| JP | 58-17913 | 2/1983 |
| JP | 58-146614 | 9/1983 |
| JP | 2006-275128 | 10/2006 |
| WO | WO/02/087964 | 11/2002 |
| WO | WO/2005/073069 | 8/2005 |

* cited by examiner

*Primary Examiner* — Frederick L Lagman
(74) *Attorney, Agent, or Firm* — Lai, Corsini & Lapus, LLC; Theodore Lapus

(57) ABSTRACT

A liquid displacement system includes a storage tank, a volume of a first gas, and a volume of a second gas. The storage tank has at least one water ballast compartment to store water and at least one liquid storage compartment to store liquid and is configured symmetrically. A pump module may also be coupled to the storage tank. The pump module has at least one pair of loading pumps operating substantially at equal mass flow rate to displace the water with the liquid, and at least one pair of offloading pumps operating substantially at equal mass flow rate to displace the liquid with the water. Also, a gas valve module may be coupled to the storage tank to control pressure of the first gas and the second gas in the storage tank. The first gas is natural gas or inert gas. The second gas is natural gas.

17 Claims, 17 Drawing Sheets

MULTIFUNCTIONAL OFFSHORE BASE WITH LIQUID DISPLACEMENT SYSTEM

CROSS-REFERENCE TO RELATED APPLICATION(S)

The present invention is a continuation in part of International Application PCT/CN2009/001008 filed on Sep. 7, 2009, now published in Chinese as WO/2010/025625, which claims the benefit of CN200810196337.9 filed on Sep. 5, 2008, all of which are hereby incorporated by reference in their entireties.

FIELD OF THE INVENTION

The present invention relates to the field of a liquid displacement system. More particularly, the present invention relates to the field of an equal mass flow rate displacement system for utilizing the storage and transportation of hydrocarbon products and being applied with multifunctional offshore base, which can include oil/gas drilling wells, and production facilities of oil, natural gas, liquefied natural gas ("LNG"), liquefied petroleum gas ("LPG"), synthetic liquid hydrocarbon, or methanol.

BACKGROUND OF THE INVENTION

This section provides background information related to the present disclosure which is not necessarily prior art.

The technology of the offshore oil/gas production currently faces two major challenges: 1) design of a floating production facility, which has good hydrodynamic performance and can be used to store and offload oil in deep water and adopted with drilling and dry-well facilities; and 2) utilization of associated gas of oil field and development of natural gas fields, which are located in deep water and far from the shore.

Regarding the first challenge, good solutions have been found, such as TLP (Tension Leg Platform), SPAR, and SEMI (Semi-submersible Platform), all of which have good hydrodynamic performance and are floating platforms able to be adopted with drilling and used in deep water. Although the ship-shaped FPSO (Floating Production, Storage and Offloading) has worse hydrodynamic performance than the three platforms mentioned above, it still can satisfy the requirement of offshore oil production and storage and be utilized in deep water even with bad conditions. Therefore FPSO has become the main type of the offshore oil production facility. Another system, FPDSO, which further adopts drilling machinery above its moon pool of the FPSO, has been researched for several years. Furthermore, about ten years ago, SBM Offshore invented the tension leg deck (TLD) to handle the challenge of large heave motions, which bring in difficulties in drilling operations and in preventing the use of dry-wells. The FPDSO can only be used in good sea conditions, due to the limitation of the ship-shaped FPDSO design. The solution for the first challenge has been provided in China patent application No. CN 200810024562.4, entitled "Floating Platform With Underwater Liquid Storage," and filed by Zhirong Wu.

However, regarding the second challenge, people have not found satisfying solutions. Compared to the development of oil fields, the development of gas fields, which relates to the storage and transportation of the natural gas, is especially difficult. The traditional solution is to use subsea pipelines to transport natural gas produced offshore to onshore users directly. The onshore users can use natural gas as fuel or chemical raw materials, or liquefy natural gas for the same use. However, it is not always economic to build subsea pipelines, when the amount of gas produced is small, the gas field is far from users, or the users lack related infrastructure. Furthermore, the utilization of associated gas is also a challenging process. Burning out the associated gas is banned by law now. However, pressing the natural gas back to the ground is costly and is not workable for all kinds of geology.

Currently, the storage and transportation of offshore natural gas often adopts the following four methods. 1. GTL (gas to liquid): synthesize natural gas to liquid hydrocarbons or methanol, and then export them by transport ships. 2. LNG: liquefy natural gas at low temperature, such as −162° C., and then export LNG by transport ships. 3. CNG (compressed natural gas): compress natural gas to some pressure, such as several ten bars or 150 bars, store it in a steel storage container, and then export it by transport ships. 4. GTW (gas to wire): use natural gas to generate electricity offshore, and then export the electricity through the subsea cables. In conclusion, the research directions lead to two aspects: 1) fixed and floating topside production facility for utilizing or converting the natural gas, which needs more efficient production processes and recovery of the natural gas, and 2) the lower base structure, especially for the floating structure, which is not only the structural basis of the topside facility, but a liquid storage tank. If it is designed for being used in a floating condition, it shall provide enough size for an adequate deck area and good hydrodynamic performance. Furthermore, the production facility shall be reliable, safe, friendly to the environment, reusable, and cost-effective.

In the last ten years, people have put a lot of efforts into the research of the production processes of GTL and LNG. LNG has become 7% of the global natural gas consumption in 2007. The demand of LNG is increasing 8~10% each year. The demand of LNG is estimated to be 5 hundred million tons in 2030. Large market demand and challenges of development of the offshore natural gas have made oil companies and engineering/construction companies invest a large amount of resources to develop floating liquefied natural gas (FLNG) and floating oil and natural gas (FLOG) systems.

However, the research in lower base structure, especially for a floating structure, still has not made any significant progress. TLP, SPAR, and SEMI usually have limited sizes of the deck area and no storage function. Although the FPDSO and FPSO have larger water plane area, the draft is not deep (usually ~20 m). Because of the vessel's larger water plane area and shallow draft, the heave motion, the pitch motion, and the roll motion of the FPSO/FPDSO system are large. Large heave motion is not good for installing drilling and dry-well in a floating structure. Although TLD can improve the heave motions of the wellhead, the problem of the heave motion of the overall floating structure still exists. Large heave, pitch, and roll motions of the floating structure also have a negative impact on the reliability of the entire system and cause fatigue damages. The problem of the instability of the existing floating structure is the reason why the synthesis of the natural gas to the liquid hydrocarbons or methanol offshore has not yet achieved any significant progress. If people can put the LNG storage underwater, where there is little wave effect, and optimize the structural configuration, such as to decrease the size of the water plane of the floating structure, the hydrodynamic performance of the structure can be improved. Therefore, a process of storage of LNG and LPG underwater becomes necessary. The solution for offshore conventional liquid storage and transportation at normal temperature and pressure has been provided in China patent application No. CN 200810024564.3, entitled "Underwater Liquid Storage, Loading, and Offloading System," and filed by Zhirong Wu. However, this solution can not be used in liquid storage and transportation at abnormal temperature or pressure, such as the LNG or LPG storage and transportation.

SUMMARY OF THE INVENTION

This section provides a general summary of the disclosure, and is not a comprehensive disclosure of its full scope or its entire feature.

In one preferred embodiment, a liquid displacement system comprises a storage tank having at least one water ballast compartment to store water and at least one liquid storage compartment to store liquid, a volume of a first gas disposed above the water, and a volume of a second gas disposed above the liquid and not fluidly interconnected with the volume of the first gas disposed above the water. The structure of the storage tank is configured symmetrically.

In other embodiments, the liquid displacement system further comprises a pump module coupled to the storage tank. The pump module comprises at least one pair of loading pumps and at least one pair of offloading pumps. The pair of loading pumps includes a liquid loading pump to load the liquid into the liquid storage compartment and a water offloading pump to offload the water out of the water ballast compartment and the pair of offloading pumps includes a water loading pump to load the water into the water ballast compartment and a liquid offloading pump to offload the liquid out of the liquid storage compartment.

In still other embodiments, the liquid displacement system further comprises an equal mass flow rate displacement system to keep a constant operating weight such that the pair of loading pumps operate substantially at equal mass flow rate to displace the water with the liquid; and also such that the pair of offloading pumps operate substantially at equal mass flow rate to displace the liquid with the water.

In still other embodiments, the water offloading pump or the liquid offloading pump is replaced by a pressure energy of the first gas in the water ballast compartment or a pressure energy of the second gas in the liquid storage compartment such that the pressure energy offloads the water or the liquid out.

In still other embodiments, the first gas is natural gas or inert gas.

In still other embodiments, the inert gas is nitrogen gas.

In still other embodiments, the second gas is natural gas.

In still other embodiments, the liquid displacement system further comprises a gas valve module coupled to the storage tank. The gas valve module comprises at least one pair of loading gas valves and at least one pair of offloading gas valves. The pair of loading gas valves includes a gas inlet valve of the water ballast compartment to control the volume of the first gas into the water ballast compartment and a gas outlet valve of the liquid storage compartment to control the volume of the second gas out of the liquid storage compartment. The pair of offloading gas valves includes a gas inlet valve of the liquid storage compartment to control the volume of the second gas into the liquid storage compartment and a gas outlet valve of the water ballast compartment to control the volume of the first gas out of the water ballast compartment.

In still other embodiments, the gas valve module operates automatically to control a variation of a pressure of the first gas in the water ballast compartment and a pressure of the second gas in the liquid storage compartment.

In still other embodiments, the liquid storage compartment is made of steel and concrete.

In still other embodiments, the liquid displacement system further comprises an insulation layer positioned between the steel for providing thermal insulation of the liquid.

In still other embodiments, the liquid displacement system further comprises solid ballast disposed adjacent to or inside the storage tank to increase weights and damping and lower a center of gravity.

In still other embodiments, the liquid displacement system further comprises a topside facility coupled to the storage tank for production and treatment of the liquid, the first gas, and the second gas. The liquid produced by the topside facility is stored directly in the storage tank. The first and the second gas circulate between the topside facility and the storage tank.

In still other embodiments, the first and the second gas circulate between the topside facility and the storage tank as close loops.

In still other embodiments, the topside facility further comprises a dry-well.

In still other embodiments, the liquid displacement system further comprises a column to structurally connect the storage tank with the topside facility.

In still other embodiments, multiple storage tanks are coupled together to form a base structure by a connecting device for improving its hydrodynamic performance. The size of the connecting device does not bar a surrounding fluid flowing adjacent to the base structure.

In still other embodiments, the liquid displacement system further comprises a solid ballast compartment coupled to the base structure. The weight distribution of the solid ballast compartment balances the difference between the buoyancy and weight distribution of the base structure for stability.

In still other embodiments, the liquid displacement system further comprises a rope to link the solid ballast compartment with the base structure.

In still other embodiments, the liquid displacement system further comprises a mooring system to moor the storage tank on a seabed in a floating condition.

In still other embodiments, the liquid displacement system further comprises a fixing device to fix the storage tank on a seabed.

In one preferred embodiment, a process of a liquid displacement system operating at equal mass flow rate comprising: supplying a gas from a topside facility to a liquid storage compartment via a gas inlet valve of it or to a water ballast compartment via a gas inlet valve of it; transporting a stored liquid or water from a bottom of the liquid storage compartment or the water ballast compartment to an inlet of a liquid offloading pump or a water offloading pump by a pressure energy of the gas from the topside facility; offloading the stored liquid or water by the respective offloading pump or only by the pressure energy of the gas; loading the water or stored liquid by respective loading pump at substantially the same mass flow rate as offloading the stored liquid or water; and exhausting the gas in the water ballast compartment via a gas outlet valve of it or in the liquid storage compartment via a gas outlet valve of it back to the topside facility.

In one preferred embodiment, a liquid displacement system comprises a topside facility for production and treatment of hydrocarbon, a bottom structure comprising at least two hollow compartments for storing water and liquid respectively, a column connecting the bottom structure with the topside facility, a volume of a first gas disposed above the water, and a volume of a second gas disposed above the liquid.

In still other embodiments, the topside facility comprises a dry-well.

In still other embodiments, the bottom structure comprises a technical compartment located inside.

In still other embodiments, the liquid displacement system further comprises a connecting device to connect multiple bottom structures to form a unity. The location of the connecting device is in correspondence to the location of the column; such that a plane is formed by the columns as two sides, the topside facility as a top side, and the connecting device as a bottom side.

In still other embodiments, the liquid displacement system further comprises a transportation module coupled to the bottom structure. The transportation module comprises at least one pair of loading pumps operating substantially at equal mass flow rate to displace the water with the liquid, and at least one pair of offloading pumps operating substantially at equal mass flow rate to displace the liquid with the water.

In still other embodiments, the first gas and the second gas are inert gas.

In still other embodiments, the liquid displacement system further comprises a valve coupled to the bottom structure. The valve opens under a first condition and therefore the two hollow compartments become a closed interconnected system. The valve closes under a second condition and therefore the two hollow compartments become two separate systems not fluidly connected to prevent liquid leakage.

In still other embodiments, the first and the second gas are natural gas and not fluidly interconnected with each other. In still other embodiments, the first gas is replaced by inert gas.

In still other embodiments, the liquid displacement system further comprises a gas valve module coupled to the bottom structure. The gas valve module comprises at least one pair of loading gas valves and one pair of offloading gas valves to control a variation of pressure of the first gas and the second gas while loading and offloading the liquid.

In still other embodiments, the liquid displacement system further comprises a solid ballast coupled to the bottom structure for adjusting an entire buoyancy and weight distribution of the liquid displacement system.

In still other embodiments, the liquid displacement system further comprises a joining device to link multiple solid ballasts to form a unity for improving hydrodynamic performance.

In still other embodiments, the liquid displacement system further comprises a mooring system to moor the bottom structure on a seabed in a floating condition.

In still other embodiments, the liquid displacement system further comprises a fixing device to fix the bottom structure on a seabed.

BRIEF DESCRIPTION OF THE DRAWINGS

The drawings described herein are for illustrating purposes only of selected embodiments and not all possible implementation and are not intended to limit the scope of the present disclosure.

DETAILED DESCRIPTION OF THE PREFERRED EMBODIMENT

The following description of the preferred embodiment is merely exemplary in nature and is no way intended to limit the invention, its application, or uses. Example embodiments will now be described more fully with reference to the accompanying drawings.

It is understood that the liquid displacement system can be used in any body of water. The term "liquid" comprises crude oil, LNG, LPG and other hydrocarbon liquids. In addition, the term "liquid" in this disclosure, with respect to liquid storage, does not refer to a physical state of a matter. Instead, the term "liquid" in this disclosure, with respect to liquid storage, refers to a target substance for storage that is different from the ambient water of the body of water within which the instant storage device is disposed. The term "water" comprises seawater and fresh water.

Liquid Displacement System for Seawater Ballast and LNG/LPG

Figure 1:
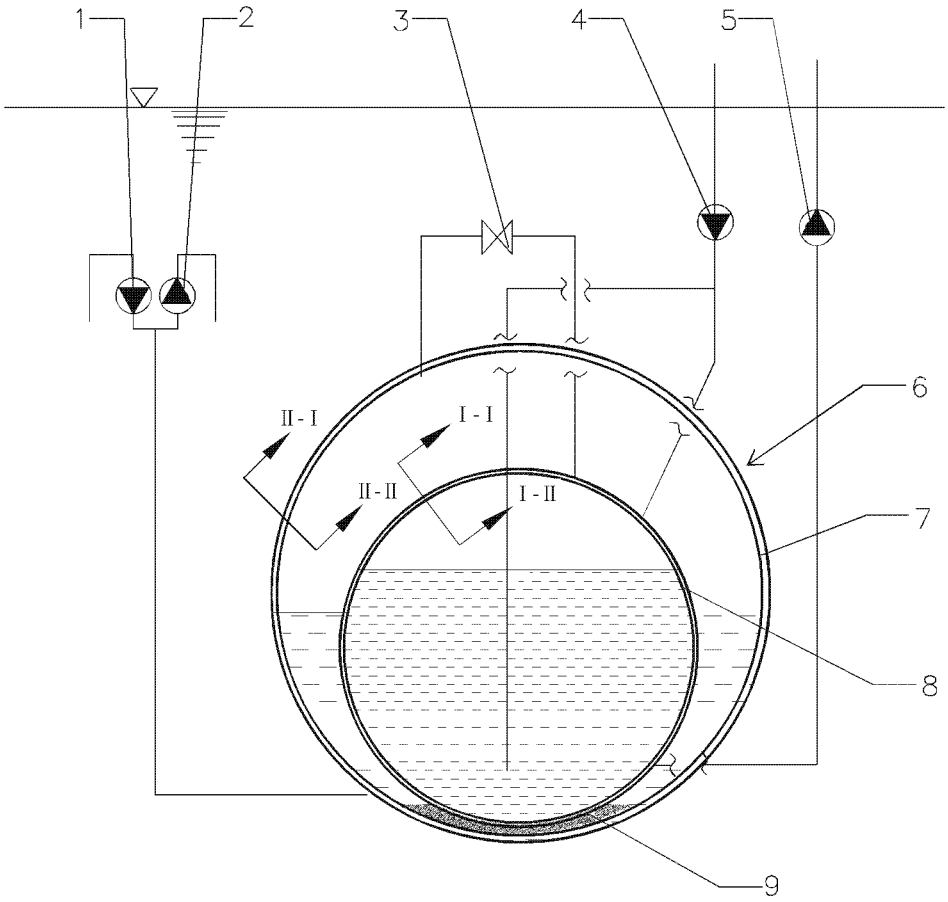
FIG. 1 is a flow chart of a storage, loading, and offloading system for liquid at normal temperature.

FIG. 1 illustrates a flow chart of a liquid storage, loading and offloading system, which has the design of multi-tank liquid storage and an equal mass flow rate displacement system for seawater ballast and stored liquid at normal temperature and pressure, as described in China patent application No. CN 200810024564.3, entitled "Underwater Liquid Storage, Loading, and Offloading System," and filed by Zhirong Wu.

Some embodiments according to the present invention are different from the invention mentioned above in two aspects: 1) utilization of natural gas during the liquid displacement process; and 2) construction of the storage tank while the stored liquid is at abnormal temperature and pressure.

Figure 2:
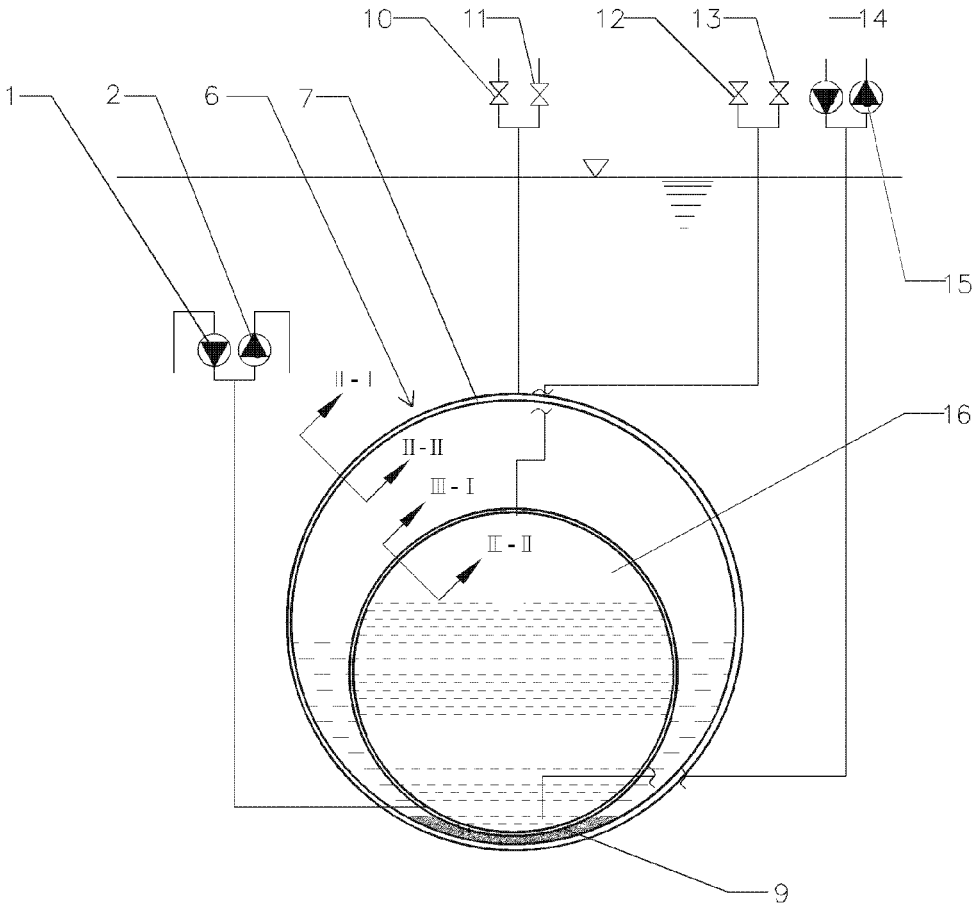
FIG. 2 is a flow chart of a liquid displacement system for LNG.

FIG. 2 illustrates a flow chart of a liquid displacement system for seawater ballast and LNG in accordance with an embodiment of the present invention. The liquid displacement system can include three main parts as follows.

1. A multi-tank liquid storage (hereinafter referred as multi-tank) 6. The multi-tank 6 includes at least one seawater ballast compartment 7 and at least one LNG storage compartment 16. Compressed natural gas is filled in the top of the seawater ballast compartment 7 and the LNG storage compartment 16. In some embodiments, the compressed natural can be from a topside facility 24 (not shown in FIG. 2, please refer to FIG. 7). In another embodiment, the compressed natural gas in the seawater ballast compartment 7 and the compressed natural gas in the LNG storage compartment 16 are not interconnected with each other and from different points of the topside facility 24.

In some embodiments, the compressed natural gas used for the seawater ballast compartment 7 can be replaced by compressed inert gas, such as nitrogen gas. The compressed nitrogen gas can be from the topside facility 24.

2. A pump module. The pump module includes at least one group of linkage pumps. Each group includes at least one pair of offloading pumps and one pair of loading pumps. The pair of offloading pumps includes a seawater loading pump 1 and a liquid offloading pump 15. The pair of loading pumps includes a seawater offloading pump 2 and a liquid loading pump 14. In some embodiments, all pumps within the pump module can start, operate, and stop at equal mass flow rate to ensure a constant operating weight of the system.

In some embodiments, if all pumps within the pump module can start, operate, and stop at equal mass flow rate, the volume flow rate of the liquid and the water is inversely proportional to the density of the liquid and the water. The pump module can be an automatic controlling system of the volume flow rate, such as a back-flow control system or a stepless speed regulating system.

3. A gas valve module. The gas valve module includes at least one group of linkage gas valves and can control the communication of the natural gas between the topside facility 24 for producing LNG and the seawater ballast compartment 7 and the LNG storage compartment 16. Each group includes at least one pair of offloading gas valves and one pair of loading gas valves. The pair of offloading gas valves includes a gas outlet valve of the seawater ballast compartment 10 and a gas inlet valve of the LNG storage compartment 13. The pair of loading gas valves includes a gas inlet valve of the seawater ballast compartment 11 and a gas outlet valve of the LNG storage compartment 12. In some embodiments, the gas valve module can operate in coordination of the pump module for achieving the liquid displacement system to operate at equal mass flow rate. The gas valve module can be operated manually or automatically.

In another embodiment, the displacement system can be applied with an emergency shutdown system, a gas controlling system, a safety system, an instrument controlling system, a sampling system, or a purging system, all of which are known to people skilled in the art.

The process of the liquid displacement system for seawater ballast and LNG operating at equal mass flow rate by using pressure energy of the natural gas and pump transportation is illustrated as follows. First, supply the natural gas from the topside facility 24 into the LNG storage compartment 16 via the gas inlet valve of it 13 or into the seawater ballast compartment 7 via the gas inlet valve of it 11. Second, transport the stored LNG or the seawater from the bottom of the LNG storage compartment 16 or the seawater ballast compartment 7 to an inlet of the liquid offloading pump 15 or the seawater offloading pump 2 by pressure energy of the natural gas. Third, offload the stored LNG or the seawater by the liquid offloading pump 15 or the seawater offloading pump 2 or only by the pressure energy of the natural gas. Fourth, load the seawater or the stored LNG by the seawater loading pump 1 or the liquid loading pump 14 at substantially the same mass flow rate as to offload the stored LNG or the seawater. Fifth, press the natural gas in the seawater ballast compartment 7 via the gas outlet valve of it 10 or in the liquid storage compartment via the gas outlet valve of it 12 back to the topside facility 24 for retrieval. The order of each step may be changed or operate at the same time, depending on the type of process. The supplement and retrieval of natural gas may be from different points of the topside facility 24.

In some embodiments, the energy to supply the natural gas to the liquid storage compartment or the seawater ballast compartment can be from the topside facility. In another embodiment, the energy to press the natural gas out of the seawater ballast compartment or the liquid storage compartment can be from the liquid loading pump or the seawater loading pump.

In some embodiments, the pressure of natural gas in both the liquid storage compartment and the seawater ballast compartment can be controlled by the operation of the linkage gas valves to ensure that the pressure energy of the natural gas can overcome the flow-resistance and potential energy for moving LNG or seawater upward. In another embodiment, the pressure of natural gas in both the liquid storage compartment and the seawater ballast compartment can be kept substantially constant or within certain range by the operation of the linkage gas valves.

In some embodiments, the natural gas supplied or exhausted from the seawater ballast compartment 7 can be replaced by inert gas, such as nitrogen gas. The exhausted nitrogen can be leaded to a high point of the topside facility for venting.

In some embodiments, the natural gas pressed into the LNG storage compartment 16 can be a dry gas at low temperature, which has been dried in the topside facility 24. The natural gas pressed into the seawater ballast compartment 7 can be a wet gas at normal temperature, which has not been dried in the topside facility 24. In another embodiment, the temperature and pressure of the natural gas would be decreased (such as to −162° C.) after being imported into the LNG storage compartment 16. The energy to cool down the imported natural gas is from the energy of vaporization of the originally stored LNG.

In some embodiments, if the pressure of compressed natural gas is large enough, the liquid or seawater offloading pump is not necessary. In another embodiment, the LNG offloading pump 15 or the seawater offloading pump 2 can be installed in the topside facility 24, if the pressure energy at the inlet of the LNG offloading pump 15 or the seawater offloading pump 2 is high enough. Otherwise, the LNG offloading pump 15 and the seawater offloading pump 2 can be installed within either a main column 25-1, a technical column 25-2, a supporting column 25-3 or a cylinder structure 23 (please refer to FIG. 7) or replaced by a submarine pump.

The liquid displacement system operating at equal mass flow rate can secure the entire weight of the liquid displacement system to keep constant. The pressed natural gas can move in different close loops between different points of the topside facility 24 and the liquid displacement system. Therefore, the environmental pollution of the natural gas emission can be avoided.

Figure 3:
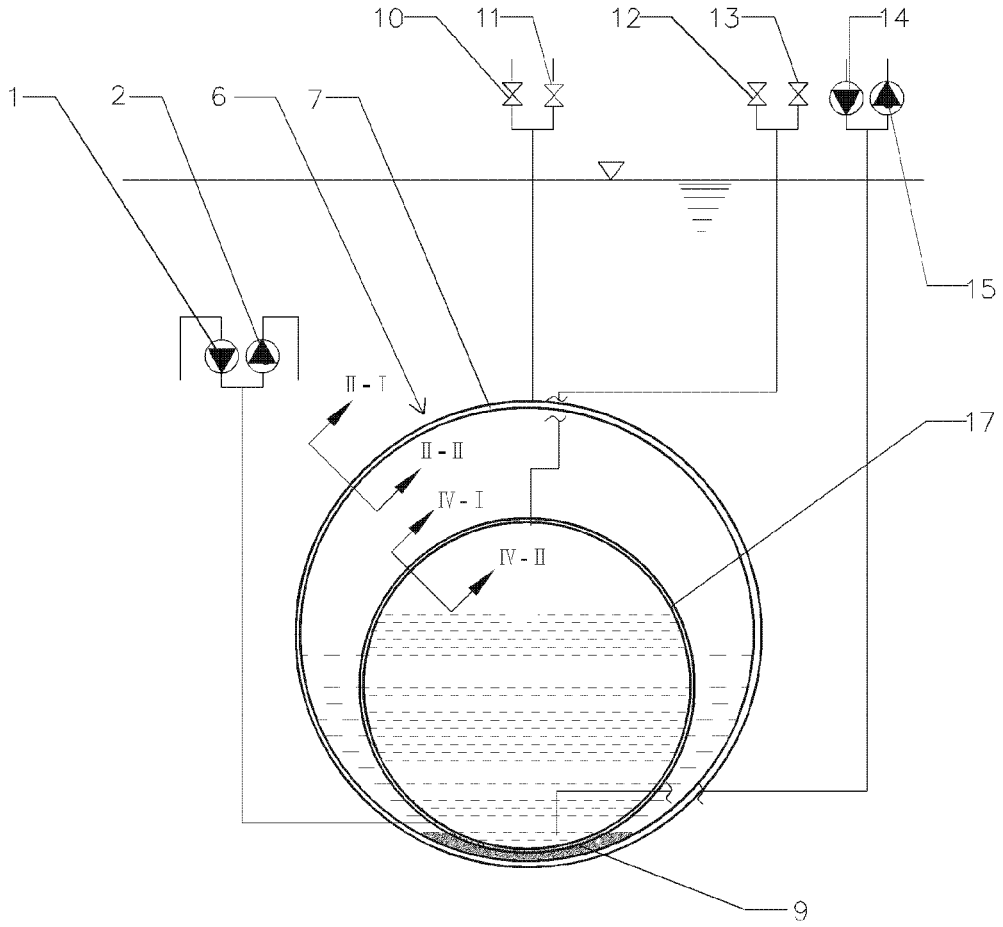
FIG. 3 is a flow chart of a liquid displacement system for LPG.

FIG. 3 illustrates a flow chart of a liquid displacement system for seawater ballast and LPG in accordance with an embodiment of the present invention. All the parts and liquid displacement process are the same as the liquid displacement system for seawater ballast and LNG illustrated in FIG. 2, except for the LPG storage compartment 17, which is designed to assist higher inner pressure and temperature than it of the LNG storage compartment 16. In some embodiments, the inner pressure of the LPG storage compartment is equal to or higher than 20 Bars. (The saturation pressure of LPG at normal temperature is 16~20 Bar.) The natural gas pressed into the LPG storage compartment 17 can be a dry gas at normal temperature, which has been dried in the topside facility 24.

Construction of the Multi-Tank Liquid Storage

1. Types of the Multi-Tank

As described in the International Application PCT/CN2009/000320, entitled "Liquid Storing and Offloading Device and Drilling and Production Installations on the Sea Based thereon," and filed by Mr. Zhirong Wu, the construction of the multi-tank 6 can have two basic types of configuration: tank-in-tank type and not tank-in-tank type. Both types of multi-tank 6 are configured symmetrically. Basically, both the structure of seawater ballast compartment 7 of the multi-tank 6 described in the above mentioned application and in some embodiments according to the present invention are the same. However, the liquid storage compartment 8 of the multi-tank 6 at normal temperature in the above mentioned application and of the multi-tank 6 at abnormal temperature and pressure in some embodiments according to the present invention, such as the LNG storage compartment 16 or the LPG storage compartment 17, are different.

With reference to FIG. 2 and FIG. 3, the multi-tank 6 can be configured as a tank-in-tank type of tank. The seawater ballast compartment 7 and the LNG storage compartment 16 or the LPG storage compartment 17 can both be horizontal spherical tanks. The LNG storage compartment 16 or the LPG storage compartment 17 can be arranged in the middle of or the lower part of the seawater ballast compartment 7. The central axes of both the seawater ballast compartment 7 and the LNG storage compartment 16 or the LPG storage compartment 17 are overlapped or parallel. In some embodiments, a horizontal supporting structure configured between the seawater ballast compartment 7 and the LNG storage compartment 16 or the LPG storage compartment 17 (not shown in the FIG. 2 or 3) can be applied to the multi-tank 6.

In another embodiment, multi-tank 6 can be configured as a not tank-in-tank type of tank, such as a storage tank in the form of a single horizontal bamboo pole with multi-section. It looks like a bamboo pole, positioned horizontally and sealed in both ends in arch shape or flat shape. Each section in the storage cell is separated by a seal plate, like a bamboo pole with multi-sections. Each seawater ballast compartment and the liquid storage compartment are like each of the sections. The single bamboo pole storage cell can have three sections. The central section is the 100% full liquid storage compartment. The other two sections are the 50% full seawater ballast compartment at both ends and connected with each other by a pipe at the top and bottom respectively (passing the liquid storage compartment or being buried in the concrete wall) to form one seawater ballast compartment in substance.

Figure 4:
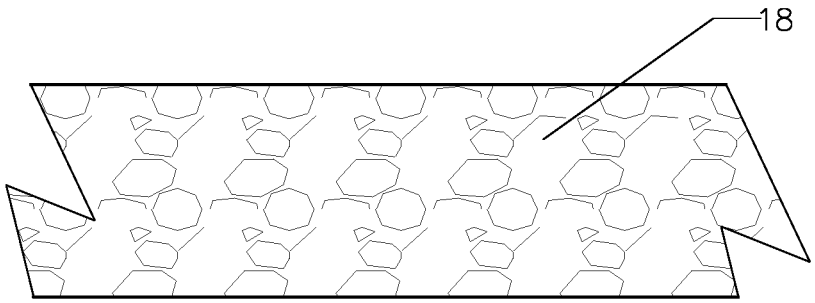
FIG. 4 is an enlarged view of the cross-section of the wall of the seawater ballast compartment taken along line II-I/II-II and the wall of the liquid storage compartment taken along line I-I/I-II in FIG. 1.

2. Comparison of the Structure of the Liquid Storage Compartment, the LNG Storage Compartment, and the LPG Storage Compartment The liquid storage compartment 8 for storing liquid at normal temperature and the seawater ballast compartment 7 both can be made of concrete. FIG. 4 illustrates an enlarged view of the cross-section of the wall of the seawater ballast compartment 7 taken along line II-I/II-II in FIG. 1~3 and the wall of the liquid storage compartment 8 taken along line I-I/I-II in FIG. 1. In some embodiments, the liquid storage compartment 8 for storing liquid at normal temperature and the seawater ballast compartment 7 also can be made of steel while more solid ballast and collusion prevention may be required.

Figure 5:
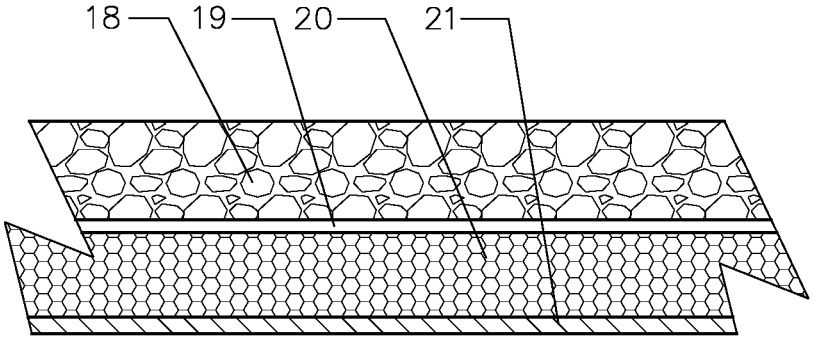
FIG. 5 is an enlarged view of the cross-section of the wall of the LNG storage compartment taken along line III-I/III-II in FIG. 2.

The LNG storage compartment 16 for storing LNG at abnormal temperature, such as −162° C., can be made of concrete, steel, and insulation materials. FIG. 5 illustrates an enlarged view of the cross-section of the wall of the LNG storage compartment 16 taken along line III-I/III-II in FIG. 2. The structure of the LNG storage compartment 16 can include an inner steel vessel 21, an outer steel vessel 19, and an insulation layer 20 in some embodiments in accordance with the present invention. The inner steel vessel 21 can be a spherical steel pressure container positioned horizontally with arch-shaped ends, made of stainless steel, which has a small coefficient of thermal expansion and can assist in keeping a low temperature, such as austenitic stainless steel 0Cr18Ni9. The outer steel vessel 19 can be a spherical steel pressure container positioned horizontally with arch-shaped ends, made of low-alloy steel, such as 16MnR. The central axes of the inner steel vessel 21 and the outer steel vessel 19 are preferably overlapped. The insulation layer 20 can be positioned between the inner steel vessel 21 and the outer steel vessel 19 and can be made of materials with good thermal insulation, such as perlite sands injected by nitrogen gas.

In some embodiments, a supporting frame between the inner steel vessel 21 and the outer steel vessel 19 can be applied with the LNG storage compartment 16 (not shown in FIG. 5). The supporting frame can be made of materials, which can assist in keeping a low temperature and have good thermal insulation, such as the combination of glass fiber reinforced epoxy and steel Cr18Ni19, and other similar materials. In another embodiment, concrete or ferroconcrete 18 can be applied to outside of the outer steel vessel 19 for prevention of collusion of the outer steel vessel 19 and increase of the solid ballast.

Figure 6:
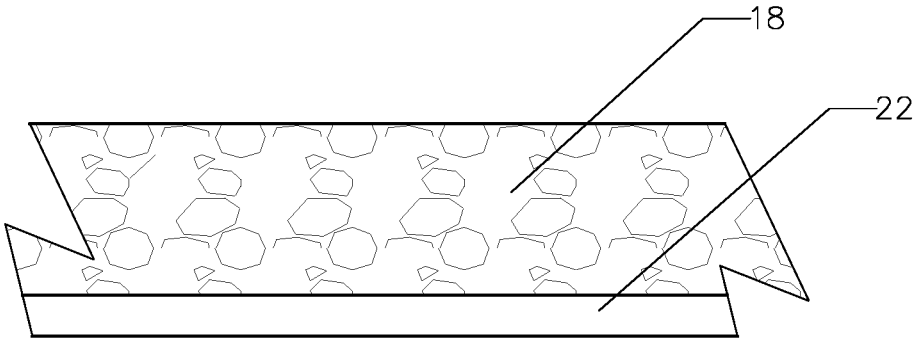
FIG. 6 is an enlarged view of the cross-section of the wall of the LPG storage compartment taken along line IV-I/IV-II in FIG. 3.

The LPG storage compartment 17 for storing LPG under abnormal pressure, for example, the inner pressure equal to or larger than 20 Bar, can be made of concrete and steel. FIG. 6 illustrates an enlarged view of the cross-section of the wall of the LPG storage compartment 17 taken along line IV-I/IV-II in FIG. 3. The structure of the LPG storage compartment 17 can include an inner steel vessel of the LPG storage compartment 22 and the ferroconcrete or concrete 18 covered outside. The inner steel vessel of the LPG storage compartment 22 can be a spherical steel pressure container positioned horizontally with arch-shaped ends, made of low-alloy steel, such as 16MnR.

3. Types of the Solid Ballast

With reference to FIG. 1~3, the multi-tank 6 in tank-in-tank type can include a solid ballast 9 inside the bottom of the seawater ballast compartment 7. In a preferable embodiment, the solid ballast 9 does not block the flow of seawater through the bottom of the seawater ballast compartment 7 by setting a conduit (not shown in figures) in the solid ballast 9 or in the inner wall of the seawater ballast compartment 7. The multi-tank 6 in the form of a single horizontal bamboo pole with multi-section also can include the solid ballast 9 on the bottom of the seawater ballast compartment or the LNG/LPG storage compartment.

Construction of the Multifunctional Offshore Base with Liquid Displacement System Multifunctional Offshore base can be configured to include a lower base structure and a topside facility. In some embodiments, the liquid displacement system operating at equal mass flow rate is also included in the offshore base construction. There are two main types of the offshore base: 1) a multifunctional floating offshore base (hereinafter referred as floating offshore base) and 2) a multifunctional bottom-supported and fixed offshore base (hereinafter referred as fixed offshore base), illustrated as follows.

1. Multifunctional Floating Offshore Base ("Floating Offshore Base")

Figure 7:
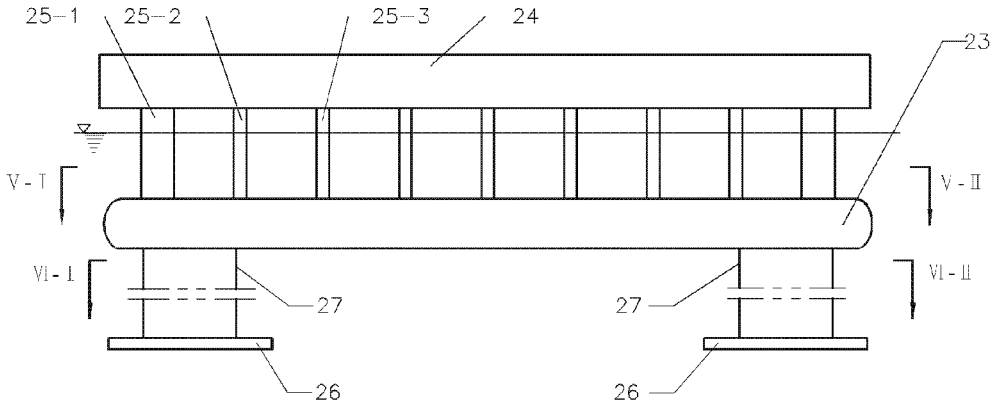
FIG. 7 is a front view of a floating offshore base.
Figure 8:
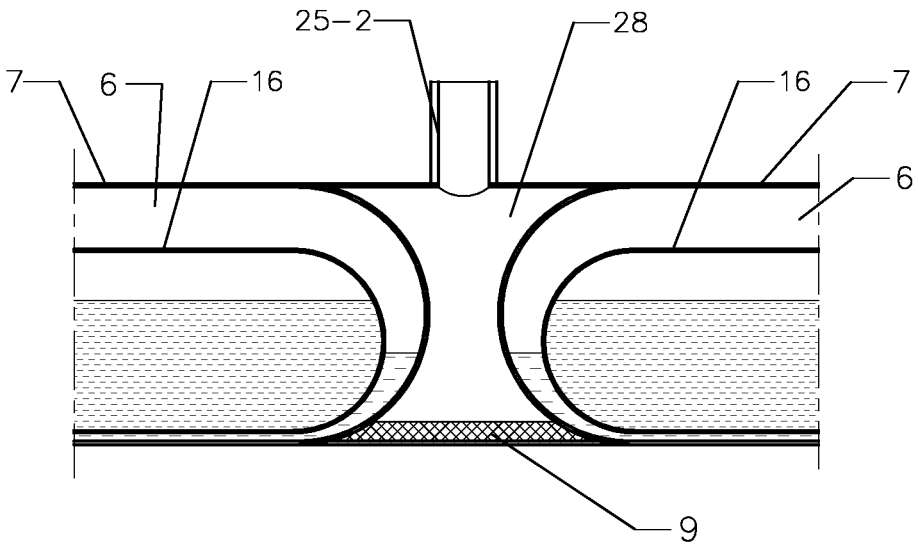
FIG. 8 is an enlarged view of cross-section of the cylinder structure taken along line VII-I/VII-II in FIG. 9.

FIG. 7 illustrates a side view of the floating offshore base, which can include a topside facility 24, a cylinder structure 23, a main column 25-1, a technical column 25-2, a supporting column 25-3, and a hanging solid ballast compartment 26.

a. The topside facility 24 can include drilling facilities, dry-wells, production facilities of hydrocarbon products, such as LNG, LPG, or oil, gas treatment system, such as dry, carbon dioxide and/or sulfureted hydrogen removal compression, and liquidation of the natural gas facilities, hydrocarbon products offloading facilities, oily water treatment facilities, utility facilities, life facilities, etc. In some embodiments, a moon pool and drilling machinery can be included and located in the center of the topside facility 24. The structure of the topside facility 24 for the floating offshore base can be a continuous single or multiple floor deck structure along the length direction of the floating offshore base, or multiple discontinuous single or multiple floor deck structure, which can be connected by a passage to form a holistic structure with bulkhead structures. The second form of structure may be safer and more flexible. The structure of the topside facility 24 can be made of concrete or steel.

b. The cylinder structure 23 can be configured by one or more multi-tanks 6 as depicted in FIG. 8. Multiple multi-tanks 6 in the cylinder structure 23 can have the same or different stored liquid. In some embodiments, a technical compartment 28 can be posed between multi-tank 6 or in the middle of the multi-tank 6 and for installation and maintenance of pipes or wires extended into the multi-tank 6, especially the installation and maintenance of complicated design of pipes, such as a LNG pipe, which needs thermal insulation. In another embodiment, the technical compartment 28 can be used for installation of the liquid offloading pump or the seawater offloading pump while the pressure energy of gas in the liquid/LNG/LPG/seawater ballast storage compartment is not high enough.

Figure 9:
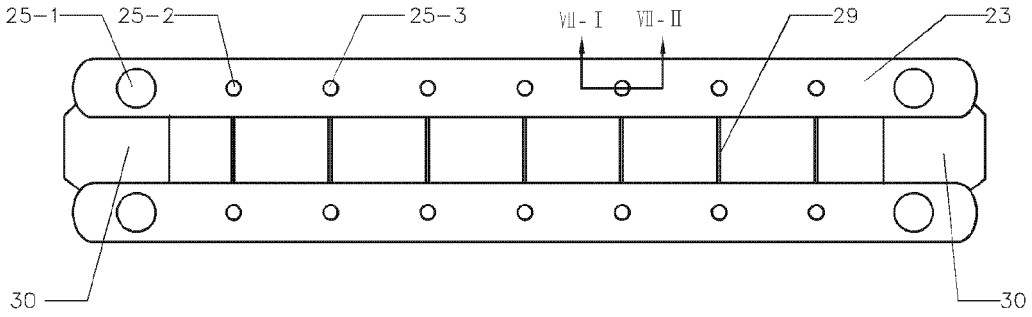
FIG. 9 is a top view of the floating offshore base taken along line V-I/V-II of FIG. 7.

With reference to FIG. 9, two or more cylinder structures 23 can be linked by a connecting device, i.e., one or more horizontal connecting bar 29 or one or more damping plate 30, to form the bottom structure of the floating offshore base. In a preferable embodiment, the cylinder structures 23 are parallel to each other and with adequate distance between therein. In another preferable embodiment, the damping plates 30 are preferably located at two ends of the cylinder structure 23.

Figure 10:
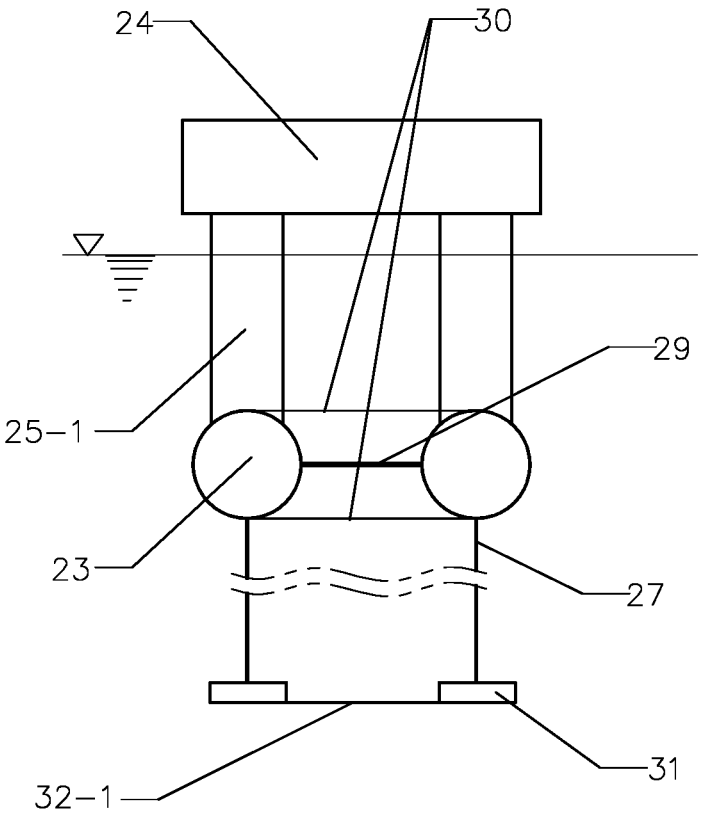
FIG. 10 is a side view of the floating offshore base along the length direction of the floating offshore base in FIG. 7.

With reference to FIG. 10, the damping plate 30 can have two kinds of designs: the single damping plate and the double damping plate. The single damping plate and the horizontal connecting bar 29 can be located in the plane, in which both the central axes of the cylinder structures 23 are located. Therefore, the single damping plate and the horizontal connecting bar 29 look overlapped in FIG. 10. The double damping plate can be located at the top and the bottom of the outer wall of the cylinder structure 23 and increase the added water mass.

The diameter of the horizontal connecting bar 29 is preferably as small as possible while the strength of it is ensured. The number of the horizontal connecting bar 29 can be decided by the structure analysis of the floating offshore base. The damping plate 30 preferably has enough water plane area to generate enough damping and added water mass. The distance between two cylinder structures 23 and the area size of the damping plate 30 can be decided by the analysis of hydrodynamic performance. Also, although the horizontal connecting bar 29 and the damping plate 30 are both located between the cylinder structures 23, the water above and below the cylinder structures 23 is still interconnected. This is the key design to improve hydrodynamic performance of the floating offshore base.

In some embodiments, like a ship-shaped FPSO, a bilge keel (not shown in FIG. 10) can be installed in the cylinder structure 23 along radial direction at 45 degrees to increase damping.

c. A column can connect the topside facility with the bottom structure of the floating offshore base. With reference to FIGS. 7 and 9, there are two rows of columns, each of which has the same cylindrical structure (or double-walled cylindrical structure near the water surface) and distribution and can be made of concrete or steel. The column can include 1) the main column 25-1 for structure supporting and being a technical shaft; 2) the technical column 25-2 for structure supporting and being a technical shaft; and 3) the supporting column 25-3 for structure supporting. The main column 25-1 has the biggest diameter and the supporting column 25-3 has the smallest diameter.

Figure 11:
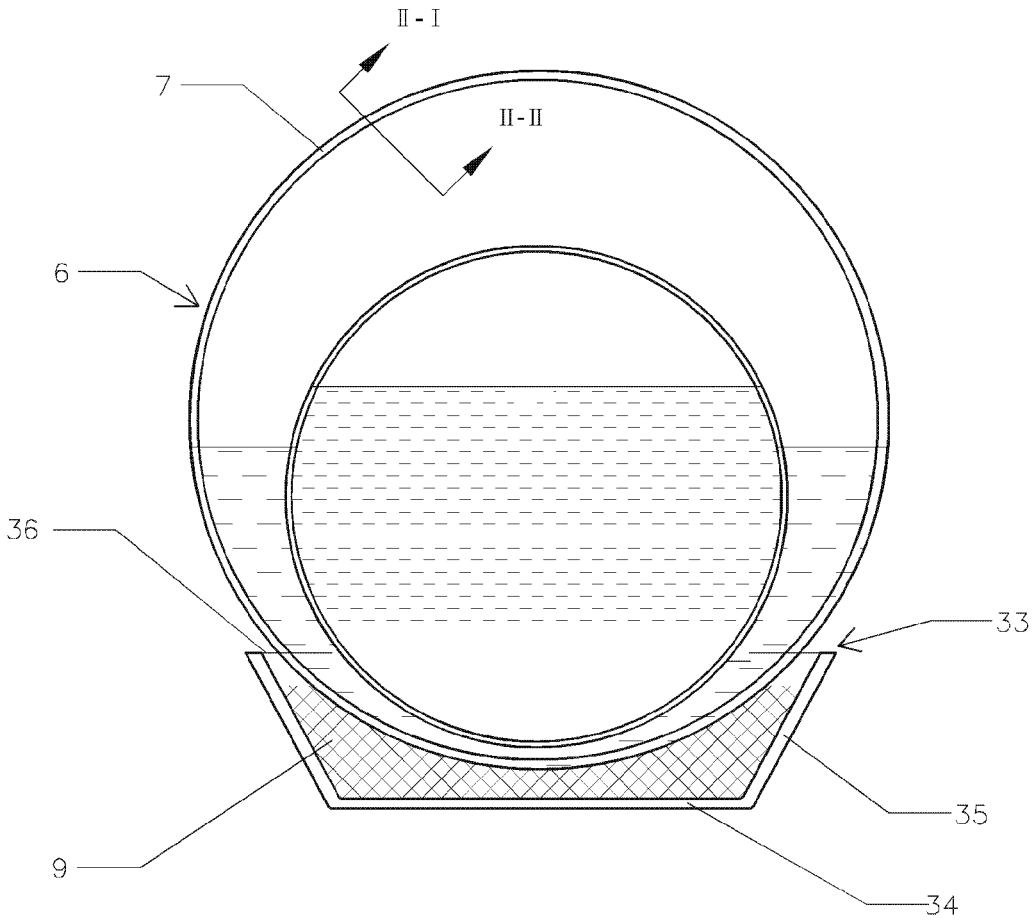
FIG. 11 is a perspective view of a floating offshore base with a solid ballast compartment.

On condition that the stability of the floating offshore base meets the requirements and its heave stiffness is not too small, the total water plane area of the columns is preferably as small as possible. Therefore, the water plane area of main columns (preferably 4 main columns), which have accounted for most of the water plan area, are preferably arranged as separately as possible. In some embodiments, four main columns 25-1 can be arranged at four corners of the two cylinder structures 23. In addition, the technical column 25-2 can be arranged at the interface of two multi-tank 6 or in the middle of the multi-tank 6. The supporting column 25-3 can be arranged according to the offshore base structure analysis. In a preferable embodiment, the arrangement of the horizontal connecting bar 29 is in coordination of the location of the columns to form a rectangle, which has two columns as two sides, the horizontal connecting bar 29 as the bottom side, and the topside facility 24 as the top side (please refer to FIG. 10). The horizontal connecting bar 29 as the bottom side is important to avoid large bending moment caused by the loading effect.

d. The solid ballast 9 can be selectively applied with the floating offshore base for balancing extra buoyancy and lowering the center of gravity. There are three kinds of methods to couple the solid ballast 9 to the floating offshore base. The first method, as mentioned previously, is to add the solid ballast 9 into the multi-tank 6 as depicted in FIGS. 1, 2, 3, and 8. The second method is depicted in FIG. 11, in which the solid ballast compartment 33 can have 2 symmetrical L-shaped open solid ballasts 9 inside, and is located beneath the cylinder structure 23. The solid ballast compartment 33 can also include a bottom plate 34, whose width is equal to or larger than the outer diameter of the cylinder structure 23, and a vertical plate 35, which inclines outward a little. The thickness of the vertical plate 35 shall be decided by the height of the solid ballast 9. In some embodiments, the solid ballast compartment can include a horizontal connecting plate 36 for connecting it with the cylinder structure 23.

Figure 12:
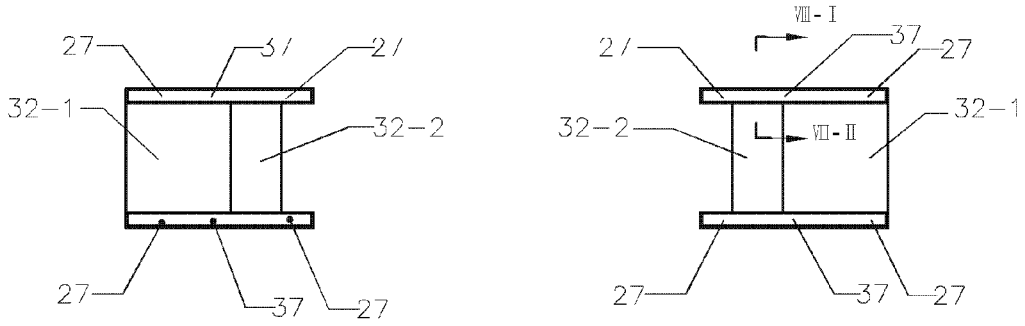
FIG. 12 is a sectional view taken along line VI-I/VI-II of FIG. 7.
Figure 13:
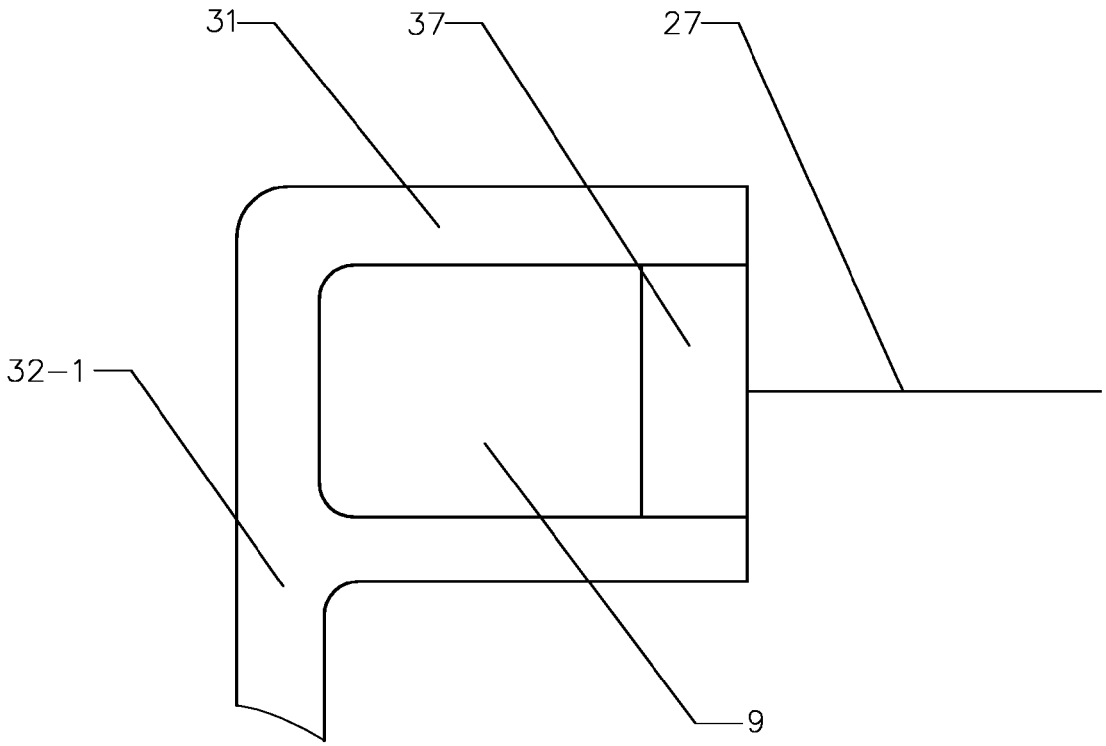
FIG. 13 is a sectional view taken along line VIII-I/VIII-II in FIG. 12.

The third method is to put the solid ballast 9 into a hanging solid ballast compartment 26 as depicted in FIG. 7. The hanging solid ballast compartment 26 is structurally separated from the cylinder structure 23, but only linked with it by a rope 27. With reference to FIG. 10, the hanging solid ballast compartment 26 can have a solid ballast container 31, which can be an open top container and linked with the cylinder structure 23 by the rope 27. With reference to FIG. 12, a sectional view taken along line VI-I/VI-II of FIG. 7, two solid ballast containers 31 can be connected by a horizontal joining frame 32-1 and a horizontal joining bar 32-2 to form a unity. In some embodiments, the horizontal joining frame 32-1 can replace the horizontal joining bar 32-2 as a damping to increase hydrodynamic performance when the solid ballast containers 31 are located below both ends of the cylinder structure 23. With reference to FIG. 13, a sectional view taken along line VIII-I/VIII-II of FIG. 12, the solid ballast container 31 can include a vertical partition 37 to stabilize the solid ballast 9 inside.

Figure 14:
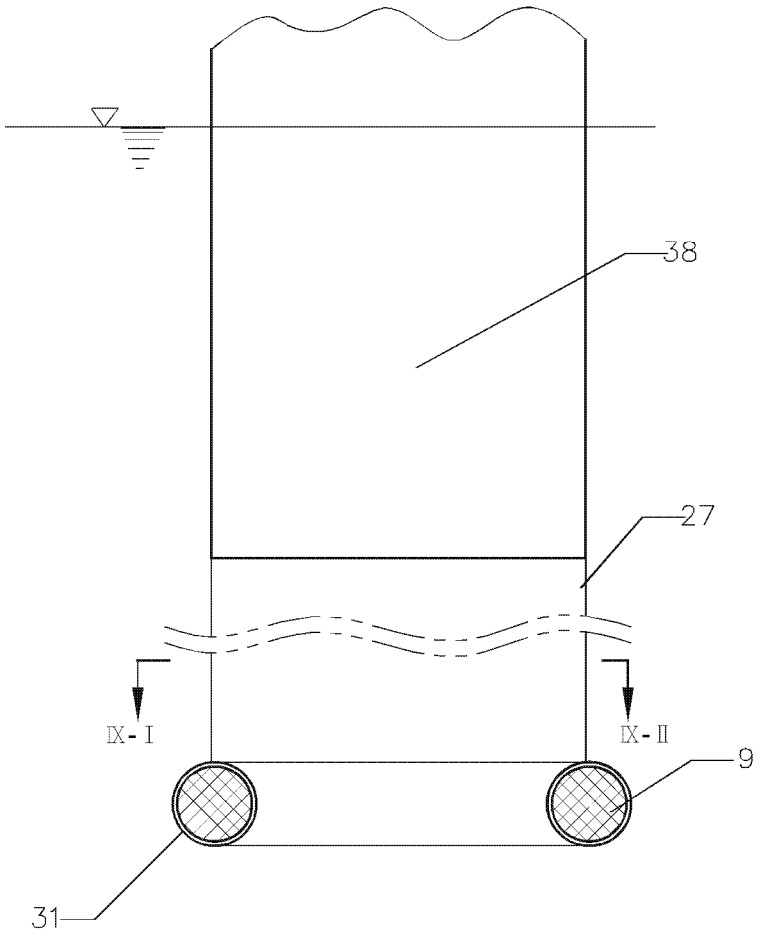
FIG. 14 is a front view of a floating offshore base.
Figure 15:
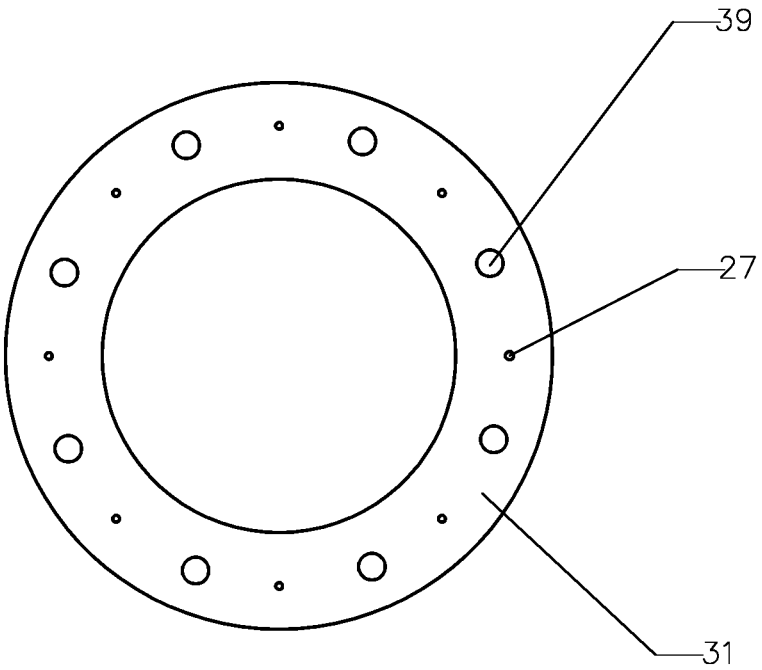
FIG. 15 is a sectional view taken along line IX-I/IX-II in FIG. 14.

In some embodiments, the solid ballast container 31 can be a closed top container or a cylinder with closed ends applied with a floating structure 38, as depicted in FIG. 14. In another embodiment, an opening 39, as depicted in FIG. 15, a sectional view taken along line IX-I/IX-II of FIG. 14, can be applied with the solid ballast container 31 with closed top for drainage, air-out, and injection of the solid ballast 9.

The weight distribution of the solid ballast compartment 33 and the hanging solid ballast compartment 26 can be symmetrical or asymmetrical along the length direction of the cylinder structure 23 and preferably arranged in coordination of the weight distribution of the cylinder structure 23 to decrease the difference between the buoyancy distribution and weight distribution of the entire floating offshore base for lowering the total bending moment of it. In some embodiments, the length of the rope 27 for the hanging solid ballast compartment 26 can be adjustable to change the location of the center of gravity of the floating offshore base.

The solid ballast container 31 can be made of concrete or steel and have rectangular, circular, or spherical shapes, which corresponds to the floating structure 38. The rope 27 can be, but not limited to, a steel rope, a steer wire, or a polyester rope. The horizontal joining frame 32-1 and a horizontal joining bar 32-2 can be made of concrete or steel. The construction of the solid ballast container 31 can be together with the construction of the floating structure 38, and then towed as a whole to offshore locations. Alternatively, the solid ballast container 31 can be linked to the floating structure 38 by the rope 37 after the offshore installation of the floating structure 38 is completed. In some embodiments, the solid ballast 9 can be injected into the solid ballast container 31 offshore.

The floating offshore base (if having two cylinder structures 23 to form the bottom structure, it is known as "Twin Sub Offshore Base (TSOB)") has the advantage of the small water plane area and deep draft. The design goal of the floating offshore base is to decrease the loading effect from the environment to balance the buoyancy, the stability and the seakeeping performance, and to avoid resonance.

The buoyancy of the floating offshore base in some embodiment in accordance with the present invention can be mostly provided by the displacement capacity of the bottom structure and partially provided by the columns. The center of gravity of the floating offshore base is usually above the center of the buoyancy of it, if no additional solid ballast compartment 26 is applied.

Regarding the stability, the moments of inertia of the floating offshore base in the water plane in some embodiments in accordance with the present invention is large, because although the water plane area of the columns is small, the distance between the columns is still large. In some embodiments, the distance between the floating offshore base's center of the gravity and the buoyancy is shortened to increase the metacentric height (GM) and restoring moments for improving stability. In another embodiment, if the center of buoyancy of the floating offshore base is above the center of the gravity of it, the effect of self-righting doll may be also applied by adding at least some solid ballast.

In addition, in order to ensure the stability while the multi-tank is broken, the following methods can be used: first, the wall of the column near the water plane can be thickened, enhanced, or double-walled. Second, if one of the seawater ballast compartments is broken, the seawater capacity in the other seawater ballast compartment in the cylinder structure can be adjusted accordingly, when the structure of the cylinder structure is symmetrical. Third, completely or partially watertight bulkhead structure can be used in the bottom of the topside facility 24 of the floating offshore base for a last defense.

Regarding the seakeeping performance, the floating offshore base in some embodiments in accordance with the present invention has good performance in the six degrees of freedom because of the good structure designs as follows. First, although the columns extend the water area with large wave effect, the total water plane area of the columns is still small due to the limited number of the columns. In addition, the main columns 25-1 with the largest water plane area are located separately with a large distance between therein. Second, the bottom structure of the floating offshore base is located at a water depth with small wave effect and the water above and below the cylinder structures 23 is still interconnected, except for the area of the damping plate 30 and the horizontal connecting bar 29. Third, installation of the hanging solid ballast compartment 26 increases the total damping and added water mass. The heaving period of the floating offshore base according to some embodiments is larger than 20 seconds, which is longer than the primary wave period (usually 12~16 seconds).

In some embodiments, a single point mooring or a spread point mooring can be applied with the floating offshore base to moor it to a seabed. The spread point mooring, like used in the submerged platform, can include mooring legs, such as catenary mooring legs, taut mooring legs, or semi-taut mooring legs, attached to the main columns 25-1 at four corners of the floating offshore base. The floating offshore base for FPDSO, FLNG and FONG can still have good hydrodynamic performance under bad sea conditions, when it is applied with the spread point mooring. The single point mooring, such as an internal turret mooring or an external turret mooring, can include mooring legs, such as catenary mooring legs, taut mooring legs, or semi-taut mooring legs, secured at the head of the floating offshore base. In some embodiments, the single point mooring can be turned by wind to improve the movement performance of the floating offshore base. It is good for FGTL design and transportation of liquid.

In some embodiments, a shuttle tank can berth tandem or alongside the floating offshore base with a single point mooring or a spread point mooring to load or offload liquid directly.

2. Multifunctional Bottom-Supported and Fixed Offshore Base ("Fixed Offshore Base")

Figure 16:
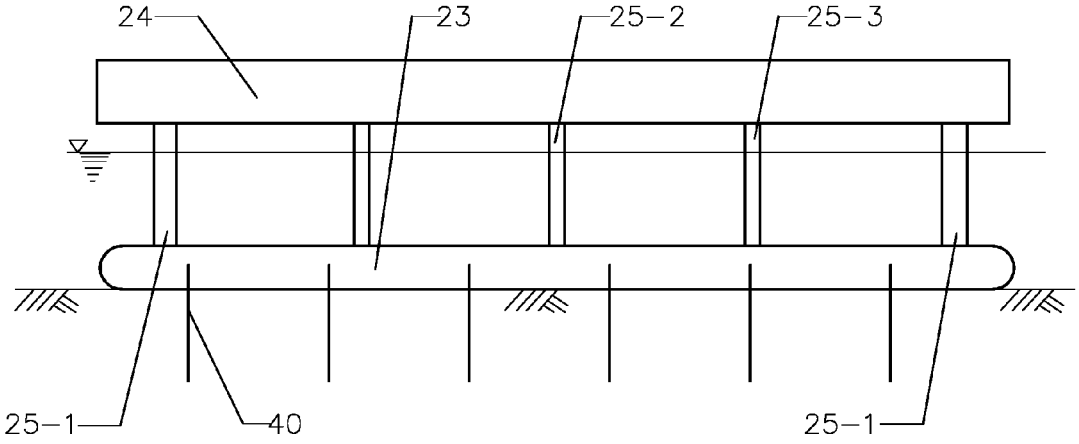
FIG. 16 is a front view of a bottom-supported and fixed offshore base.
Figure 17:
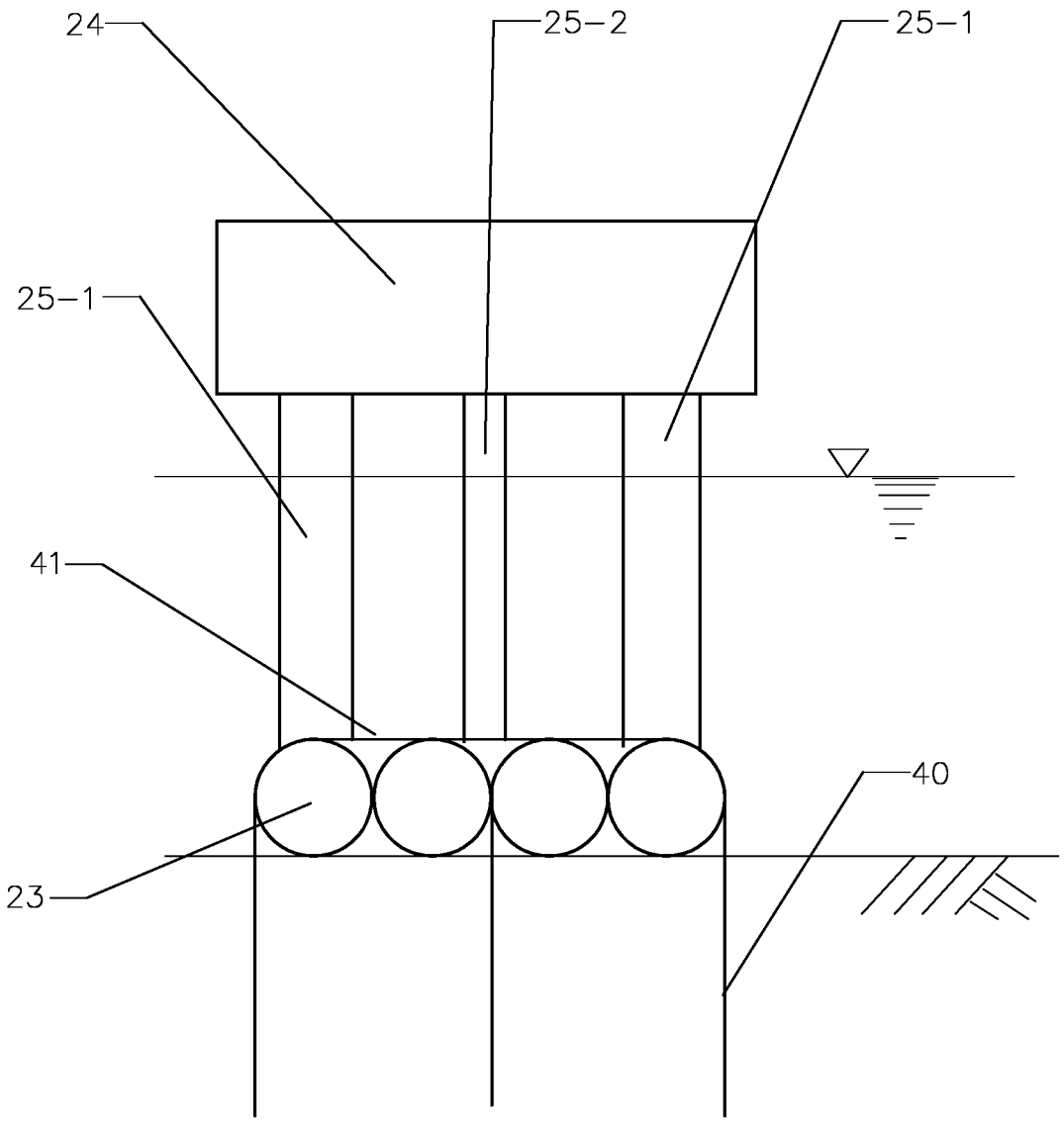
FIG. 17 is a side view of the bottom-supported and fixed offshore base along the length direction of the bottom-supported and fixed offshore base in FIG. 16.

Similar to the floating offshore base, the fixed offshore base also can include the topside facility 24, the main column 25-1, the technical column 25-2, the supporting column 25-3, and the cylinder structure 23. In addition, the fixed offshore base can further include a fixing device 40 and a horizontal frame 41 as depicted in FIGS. 16 and 17.

The bottom structure of the fixed offshore base is formed by one or more cylinder structure 23. In some embodiments, multiple cylinder structures 23 can be connected by the horizontal frame 41 to form a raft-shaped structure. The fixing device 40 for securing the fixed offshore base on a seabed can be, but not limited to piles, suction piles, or anti-sliding plates. The operating weight of the fixed offshore base can be equal to or a little bit larger than the displacement tonnage of it. In some embodiments, to avoid too much internal force aggregated at the root of the technical columns 25-2 or supporting columns 25-3, which are installed on the horizontal frame 41, the columns can be installed on underwater piles, which are punched into the seabed and extend upward through the bottom of the fixed offshore base, to release the force from the columns acting on the bottom structure of the fixed offshore base.

3. Construction and Installation of the Multifunctional Offshore Base

Most of the structure of the multifunctional offshore base is made of steel or ferroconcrete as described in the International Application PCT/CN2009/000320, except for the LNG storage compartment 16, LPG storage compartment 17, or the horizontal connecting bar 29 (if the tensile force is too large), all of which are made of steel.

There are several ways to construct the multifunctional offshore base, including (onshore) dry one-step construction and dry & wet two-step construction. One-step method means that the whole offshore base is constructed onshore and then dragged to offshore an oilfield to be installed. Two-step method means that part of construction is done onshore and the other part of construction is done offshore. The offshore base or the solid ballast container constructed onshore can be moved out of the dry dock by a ship or a floating object.

4. Advantage of the Multifunctional Offshore Base

The multifunctional offshore base according to the present invention solves the problem of utilization of offshore natural gas for LNG, GTL, CNG, and GTW systems and the problems of installation of drilling and dry-well in FPSO by providing a stable structural design with a bigger deck area for installation of drilling, dry-well, and other topside facilities. The multifunctional offshore base in some embodiments in accordance with the present invention can be used with the liquid storage, loading, and offloading system with equal mass liquid displacement system under a closed interconnection system as described in the International Application PCT/CN2009/000320 and the U.S. patent application Ser. No. 12/890,495 to handle storage and transportation of LNG/LPG and oil at the same time.

The U.S. patent application Ser. No. 12/890,495, which is a continuation application of the International Application PCT/CN2009/000320, is hereby incorporated by reference in its entirety. In the U.S. patent application Ser. No. 12/890,495, hydrocarbon liquid, such as oil, can be stored in the multi-tank 6 at normal temperature and pressure as depicted in FIG. 1, and loaded/offloaded at equal mass flow rate as corresponding offloaded/loaded seawater ballast by a linkage pump module and circulation of inert gas inside. The multi-tank 6, which is configured symmetrically, can include a seawater ballast compartment 7 and a hydrocarbon liquid storage compartment 8. Inert gas can be filled above the seawater and the hydrocarbon liquid in the seawater ballast compartment 7 and the hydrocarbon liquid storage compartment 8. The seawater ballast compartment 7 and the hydrocarbon liquid storage compartment 8 can be fluidly coupled to each other to form a selectively closed interconnected system. The multi-tank 6 can further include a valve 3 connected to the seawater ballast compartment 7 and the hydrocarbon liquid storage compartment 8. The valve opens under a first condition and therefore the seawater ballast compartment 7 and the hydrocarbon liquid storage compartment 8 become a closed interconnected system. The valve closes under a second condition and therefore the seawater ballast compartment 7 and the hydrocarbon liquid storage compartment 8 become two separate systems not fluidly connected. The linkage pump module can include at least one pair of loading pumps and at least one pair of offloading pumps. The pair of loading pumps can include a liquid loading pump 4 to load hydrocarbon liquid into the hydrocarbon liquid storage compartment 8 and a seawater offloading pump 2 to offload seawater out of the seawater ballast compartment 7. The pair of offloading pumps can include a liquid offloading pump 5 to offload hydrocarbon liquid out of the hydrocarbon liquid storage compartment 8 and a seawater loading pump 1 to load seawater into the seawater ballast compartment 7.

In summary, both the floating offshore base and the fixed offshore base have the following advantages: simple system and structure, easy to construct, short construction period, low capital, operation and maintenance costs, good anti-corrosive performance, long service life of the structure, no pollution, and flexible installation and relocation for reuse. They are suitable for not only large-sized oil and gas fields with long production life, but also small-sized oil and gas fields with short production life, especially for marginal oil and gas fields.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A liquid displacement system operating at an equal mass flow rate and comprising:

a storage tank comprising at least one water ballast compartment to store a water and at least one liquid storage compartment to store a liquid, said liquid storage compartment not fluidly interconnected with the water ballast compartment and wherein the structure of the storage tank is configured symmetrically;

a volume of a first gas disposed above the water; a volume of a second gas disposed above the liquid and not fluidly interconnected with the volume of the first gas disposed above the water; and further comprising a pump module coupled to the storage tank, wherein the pump module comprises at least one pair of loading pumps and at least one pair of offloading pumps; wherein the pair of loading pumps include a liquid loading pump to load the liquid into the liquid storage compartment and a water offloading pump to offload the water out of the water ballast compartment; and wherein the pair of offloading pumps include a water loading pump to load the water into the water ballast compartment and a liquid offloading pump to offload the liquid out of the liquid storage compartment;

and wherein the pair of loading pumps operate substantially at equal mass flow rate to displace the water with the liquid; and also such that the pair of offloading pumps operate substantially at equal mass flow rate to displace the liquid with the water to keep a constant operating weight.

2. The liquid displacement system according to claim 1 wherein the water offloading pump or the liquid offloading pump is replaced by a pressure energy of the first gas in the water ballast compartment or a pressure energy of the second gas in the liquid storage compartment such that the pressure energy offloads the water or the liquid out.

3. The liquid displacement system according to claim 1 further comprising a gas valve module coupled to the storage tank; wherein the gas valve module comprises at least one pair of loading gas valves and at least one pair of offloading gas valves; wherein the pair of loading gas valves include a gas inlet valve of the water ballast compartment to control the volume of the first gas into the water ballast compartment and a gas outlet valve of the liquid storage compartment to control the volume of the second gas out of the liquid storage compartment; and wherein the pair of offloading gas valves include a gas inlet valve of the liquid storage compartment to control the volume of the second gas into the liquid storage compartment and a gas outlet valve of the water ballast compartment to control the volume of the first gas out of the water ballast compartment.

4. The liquid displacement system according to claim 3 wherein the gas valve module operates automatically to control a variation of a pressure of the first gas in the water ballast compartment and a pressure of the second gas in the liquid storage compartment.

5. The liquid displacement system according to claim 1 further comprising a topside facility coupled to the storage tank for production and treatment of the liquid, the first gas, and the second gas; wherein the liquid produced by the topside facility is stored directly in the storage tank; and wherein the first gas and the second gas circulating between the topside facility and the storage tank.

6. The liquid displacement system according to claim 5 wherein the first gas and the second gas circulating between the topside facility and the storage tank as close loops.

7. The liquid displacement system according to claim 5 wherein the topside facility further comprising a dry-well.

8. The liquid displacement system according to claim 5 further comprising a column to structurally connect the storage tank with the topside facility.

9. A liquid displacement system comprising:

a multiple storage tank comprising at least one water ballast compartment to store a water and at least one liquid storage compartment to store a liquid, said liquid storage compartment not fluidly interconnected with the water ballast compartment and wherein the structure of the storage tank is configured symmetrically;

a volume of a first gas disposed above the water;

a volume of a second gas disposed above the liquid and not fluidly interconnected with the volume of the first gas disposed above the water;

and wherein the multiple storage tanks are coupled together to form a base structure by a connecting device for improving its hydrodynamic performance; wherein the size of the connecting device does not bar a surrounding fluid flowing adjacent to the base structure.

10. The liquid displacement system according to claim 9 further comprising a solid ballast compartment coupled to the base structure; wherein the weight distribution of the solid ballast compartment balances the difference between the buoyancy and weight distribution of the base structure for stability.

11. The liquid displacement system according to claim 10 further comprising a rope to link the solid ballast compartment with the base structure.

12. A process of a liquid displacement system operating at equal mass flow rate comprising:

supplying a gas from a topside facility to a liquid storage compartment via a gas inlet valve of it or to a water ballast compartment via a gas inlet valve of it;

transporting a stored liquid or a water from the bottom of the liquid storage compartment or the water ballast compartment to an inlet of a liquid offloading pump or a water offloading pump by a pressure energy of the gas from the topside facility;

offloading the stored liquid or the water by the respective offloading pump or only by the pressure energy of the gas;

loading the water or the stored liquid by respective loading pump at substantially the same mass flow rate as offloading the stored liquid or the water; and exhausting the gas in the water ballast compartment via a gas outlet valve of it or in the liquid storage compartment via a gas outlet valve of it back to the topside facility.

13. A liquid displacement system comprising:

a topside facility for production and treatment of hydrocarbon;

a bottom structure comprising at least two hollow compartments for separately storing a water and a liquid respectively, said water and liquid not fluidly interconnected;

a column connecting the bottom structure with the topside facility;

a volume of a first gas disposed above the water; and a volume of a second gas disposed above the liquid, and not fluidly interconnected with said volume of a first gas; wherein the first gas and the second gas are inert gas;

and further comprising: a connecting device to connect multiple bottom structures to form a unity; wherein the location of the connecting device is in correspondence to the location of the column; such that a plane is formed by the columns as two sides, the topside facility as a top side, and the connecting device as a bottom side.

14. The liquid displacement system according to claim 13 further comprising a transportation module coupled to the bottom structure; wherein the transportation module comprises at least one loading device and at least one offloading device; wherein the loading device loads the liquid into the bottom structure and offloads the water out of the bottom structure at substantially equal mass flow rate; wherein the offloading device offloads the liquid out of the bottom structure and loads the water into the bottom structure at substantially equal mass flow rate.

15. The liquid displacement system according to claim 13 further comprises a valve coupled to the bottom structure; wherein the valve opens under a first condition and therefore the two hollow compartments become a closed interconnected system; and wherein the valve closes under a second condition and therefore the two hollow compartment become two separate systems not fluidly connected to prevent liquid leakage.

16. The liquid displacement system according to claim 13 further comprises a gas valve module coupled to the bottom structure; wherein the gas valve module comprises at least one pair of loading gas valves and one pair of offloading gas valves to control a variation of pressure of the first gas and the second gas while loading and offloading the liquid.

17. The liquid displacement system according to claim 13 comprising a solid ballast coupled to the bottom structure for adjusting an entire buoyancy and weight distribution of the liquid displacement system; and further comprising a joining device to link multiple solid ballasts to form a unity for improving hydrodynamic performance.

* * * * *